US005336141A

United States Patent [19]

Vittone

[11] Patent Number: 5,336,141

[45] Date of Patent: Aug. 9, 1994

[54] EXERCISE MACHINE FOR SIMULATING PERAMBULATORY MOVEMENT

[76] Inventor: Larry W. Vittone, Rte. 2, Box 23, Ollis Dr., Oliver Springs, Tenn. 37840

[21] Appl. No.: 951,672

[22] Filed: Sep. 25, 1992

[51] Int. Cl.[5] ..... A63B 22/00

[52] U.S. Cl. ..... 482/51; 482/70; 482/130

[58] Field of Search ..... 482/51, 52, 54, 70, 482/71, 77, 129, 130

[56] References Cited

U.S. PATENT DOCUMENTS

| | | | |
|---|---|---|---|
| 3,824,994 | 7/1974 | Soderberg, Sr. | 482/51 |
| 4,492,374 | 1/1985 | Lekhtman et al. | 482/77 |
| 4,850,585 | 7/1989 | Dalebout | 482/51 |
| 4,861,023 | 8/1989 | Wedman | 482/51 |
| 4,880,226 | 11/1989 | Krantz | 482/71 |

*Primary Examiner*—Richard J. Apley
*Assistant Examiner*—Lynne A. Reichard
*Attorney, Agent, or Firm*—Luedeka, Neely & Graham

[57] ABSTRACT

The specification discloses an exercise apparatus for simulating a variety of perambulatory movements such as walking, stair climbing, jogging, skiing, and jumping. In one embodiment, oscillators in the nature of leaf springs are pivotally suspended side-by-side from a frame for oscillatory movement after the manner of step paths. The feet of a user are positioned in foot supports mounted on the springs. To exercise, the user exerts forces on the springs to simulate perambulatory movements, flexing and oscillating the springs in a desired manner according to the degree of exertion appropriate for the user.

34 Claims, 5 Drawing Sheets

EXERCISE MACHINE FOR SIMULATING PERAMBULATORY MOVEMENT

This invention relates generally to physical conditioning devices. More particularly, the invention relates to exercise equipment for simulating a variety of exercises involving perambulatory movement.

Walking, stair climbing, jogging, skiing, and jumping are examples of activities which involve perambulatory movement of the body. Such activities are considered to be healthful exercise in that they stimulate circulation and exercise the muscles. Exercise machines have been proposed to simulate various aspects of these activities but no known machine closely simulates a wide range of perambulatory movements in a single mechanism which is simple to use and uncomplicated to build.

Accordingly, it is an object of the invention to provide an improved exercise machine.

It is another object of the invention to provide an exercise machine which simulates perambulatory movement.

A further object of the invention is to provide an exercise machine of the character described which enables a user to simulate a variety of perambulatory movements.

Still another object of the invention is to provide an exercise machine of the character described which enables a user to simulate movements involved in walking, stair climbing, jogging, skiing, and jumping.

Yet another object of the present invention is to provide an exercise machine of the character described which is uncomplicated in configuration and simple to use.

Having regard to the foregoing and other objects, the present invention is directed to an exercise machine for simulating perambulatory movement which comprises a frame, a pair of oscillators, each of the oscillators including a foot support thereon for supporting a foot of the user, supports for supporting the oscillators on the frame with the foot supports in spaced-apart side-by-side relationship to provide oscillatory movement of the foot supports along generally parallel side-by-side step paths, and structure for providing resiliently biased movement of the foot supports of the oscillators generally perpendicular to the step paths during movement of the foot supports along the foot paths.

The features of the invention enable a user to simulate leg movements closely resembling a wide range of perambulatory motion wherein the feet alternately cycle forwardly and backwardly, for example, as viewed from above while cycling through an arch-shaped path as viewed from the side after the manner of walking, running, jogging and the like. At the same time, the user is able to exert a force in opposition to the bias against vertical movement of the foot supports to achieve a degree of user control over the effort expended.

In a preferred embodiment, the exercise machine of the invention includes a pair of leaf springs suspended from their ends by links from a frame for side-by-side movement in a gliding fashion along generally parallel spaced-apart step paths. The feet of the user are positioned in foot supports mounted on the springs and during exercise the legs of the user are moved in the manner of the desired perambulation to exert force on the leaf springs causing oscillation of the springs along their respective paths. The leaf springs flex and pivot in response to downward forces applied by the user so that activities including walking, stair climbing, jogging, skiing, and jumping may be closely simulated.

The above and other features and advantages of the invention will now be further described in the following detailed description in conjunction with the accompanying drawings in which.

Figure 1:
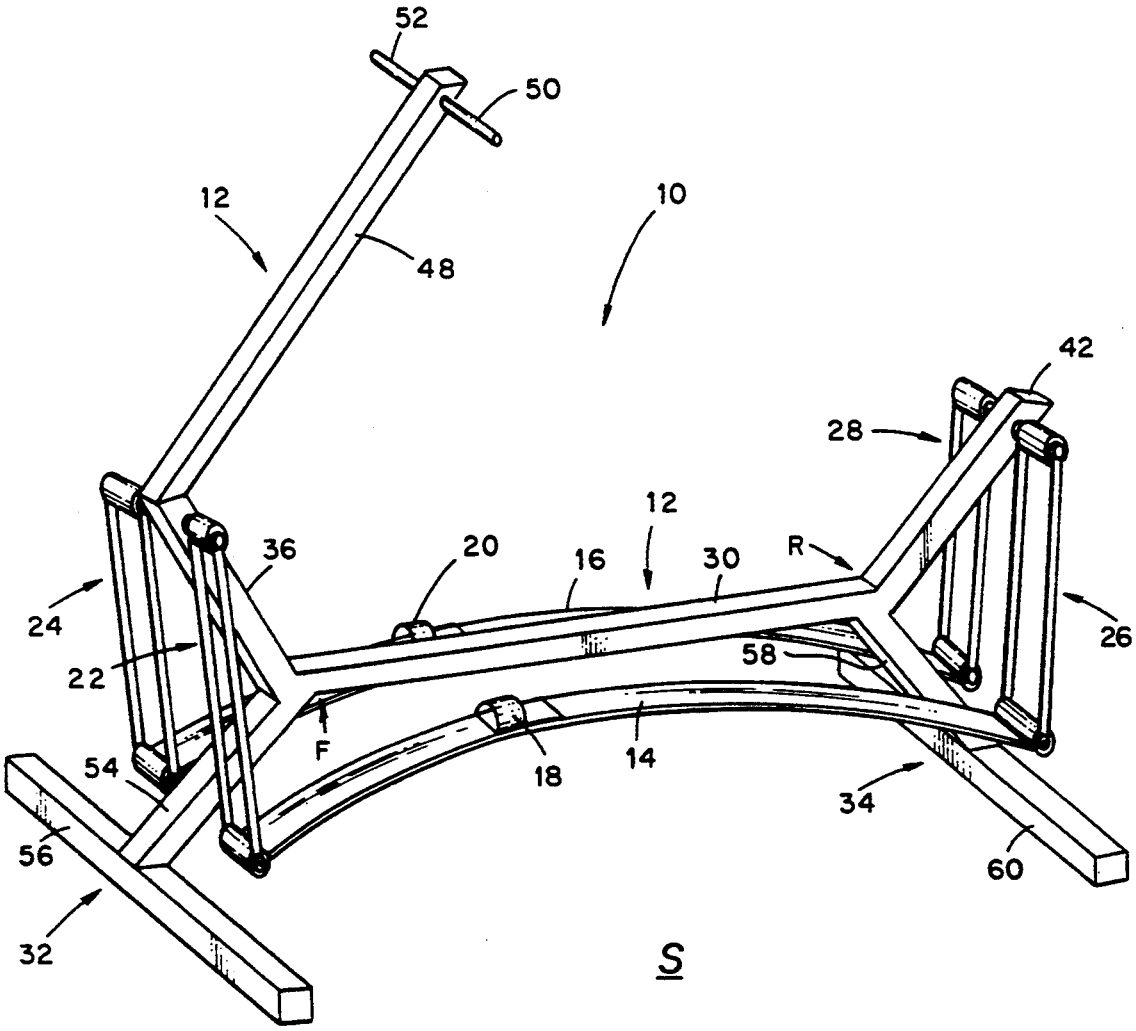
FIG. 1 is a perspective view of a preferred embodiment of an exercise machine in accordance with the invention for simulating perambulatory movements.
Figure 4:
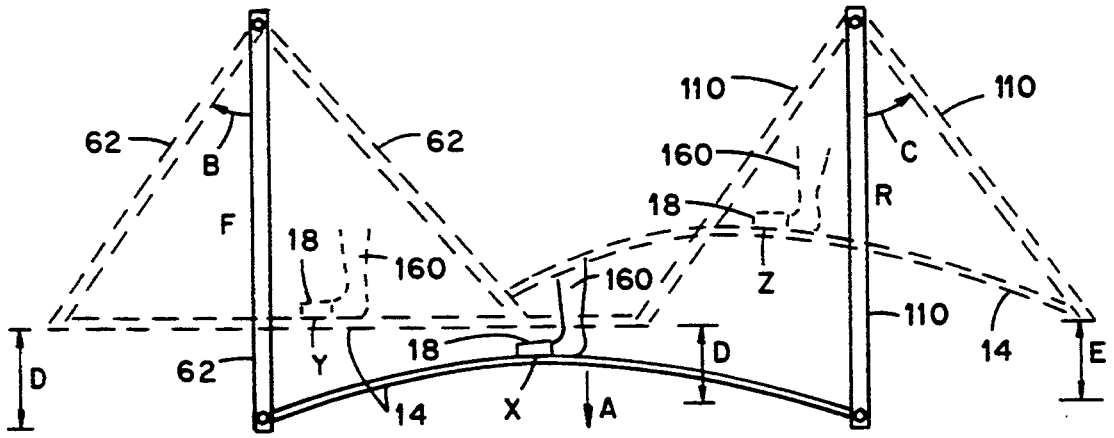
Figure 5:
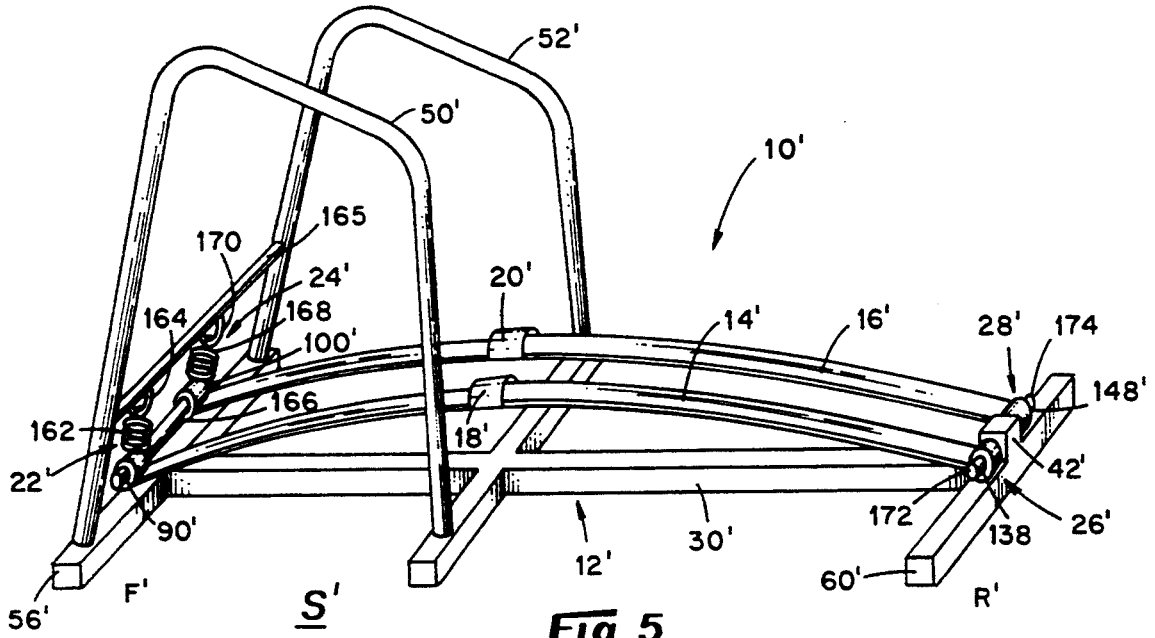
Figure 6:
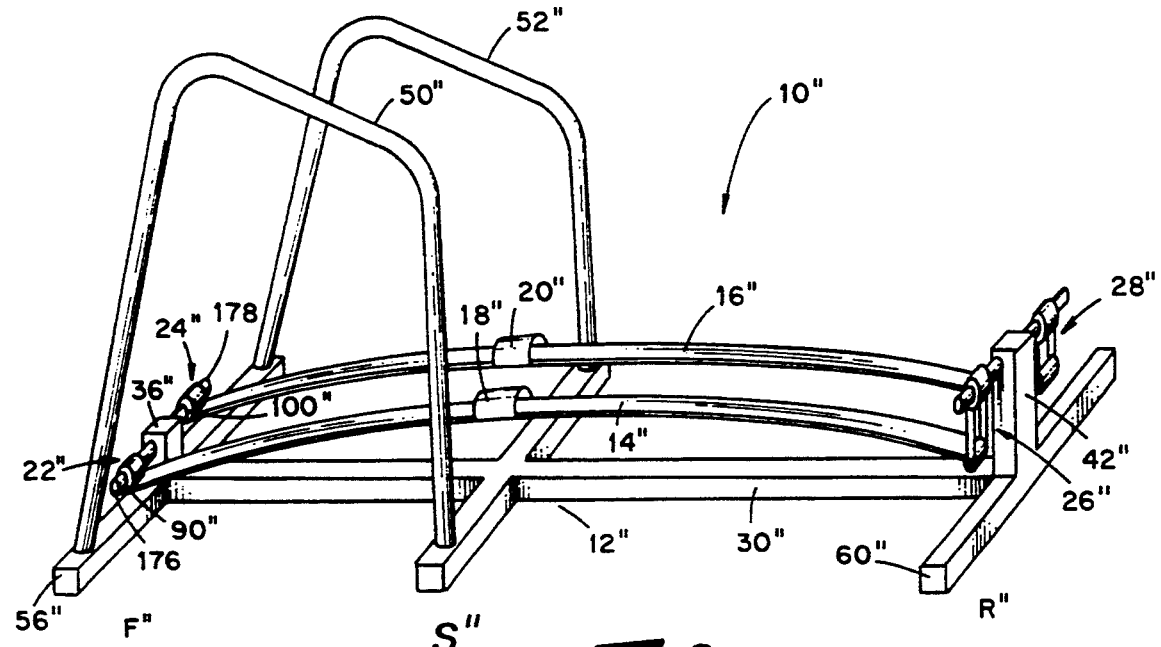
Figure 7:
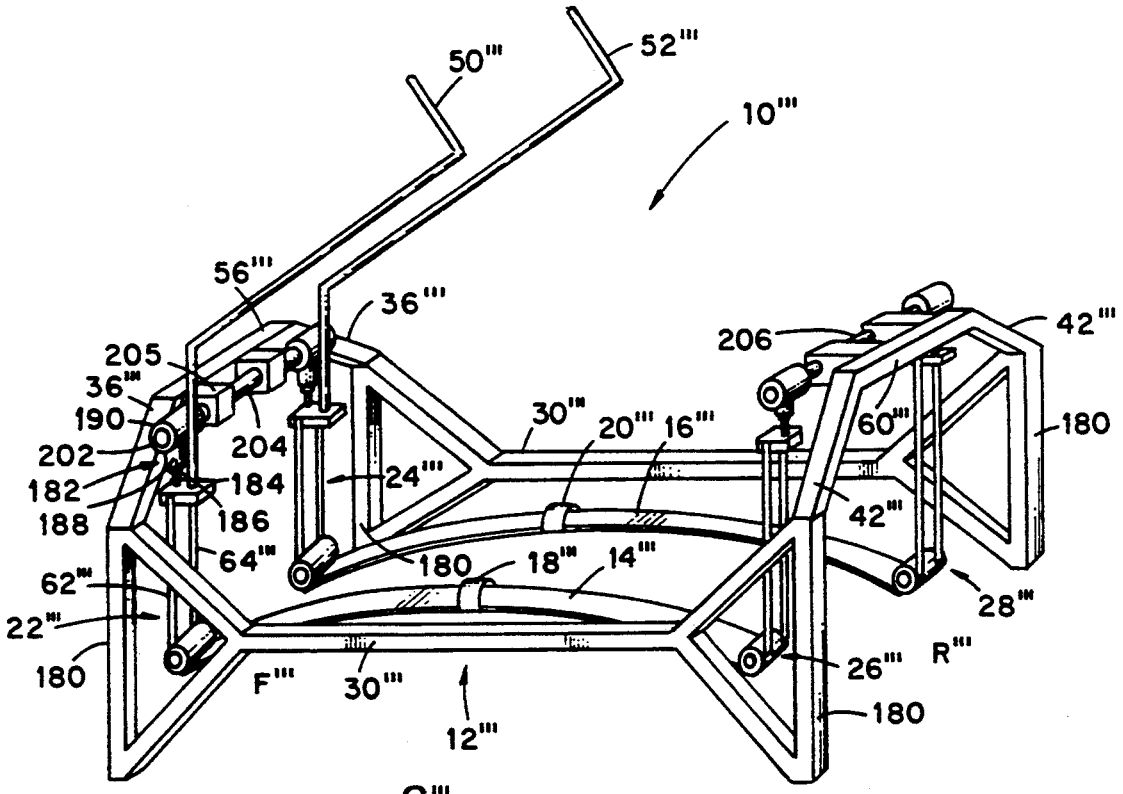
Figure 8:
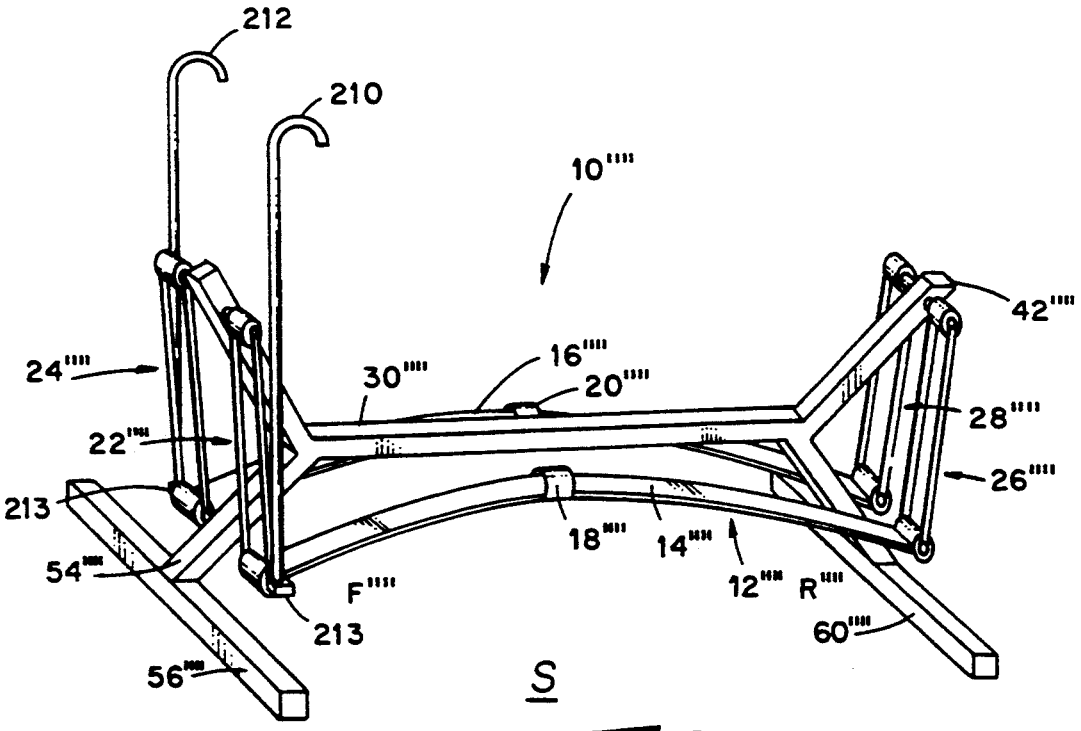

FIG. 4 fragmentary diagrammatic view of the FIG. 1 machine illustrating the foot positions of a user when simulating a perambulatory movement;

FIG. 5 is a perspective view of a further embodiment of an exercise machine according to the invention in which the rear-end of each oscillator is non-pivotally suspended from the frame and the front-end is suspended by coil springs;

FIG. 6 is a perspective view of another embodiment of an exercise machine according to the invention in which the front-end of each oscillator is non-pivotally suspended from the frame;

FIG. 7 is a perspective view of yet another embodiment of an exercise machine according to the invention wherein the oscillators are suspended by ball joints from the frame; and FIG. 8 is a perspective view of still another embodiment of an exercise machine according to the invention incorporating handles attached to the oscillators.

With reference now to the drawings in further detail wherein like reference characters designate like or similar parts throughout the several views, there is shown in FIG. 1 an exercise machine 10 embodying various features of the present invention for simulating perambulatory movement. The machine 10 includes a frame 12, a pair of oscillators 14 and 16, a pair of foot supports 18 and 20 located on the oscillators, a front left-hand oscillator support 22, a front right-hand oscillator support 24, a rear left-hand oscillator support 26, and a rear right-hand oscillator support 28.

In general, a user places a foot in each foot support 18, 20 and exerts force on the oscillators 14, 16 by moving the legs in a step path corresponding to the desired manner of perambulation. The forces supplied to the oscillators by the user are resisted by the oscillators as the oscillators are moved in a path which corresponds to the step path. For example, walking may be simulated by moving the legs as if walking on solid ground. The oscillators react to the walking motion by flexing and pivoting in a direction which corresponds generally to the walking motion and thus simulates the perambulatory movement of walking. Because the oscillators flex and pivot in a direction which corresponds to the desired perambulation, the machine allows simulation of a wide range of perambulatory movements.

Figure 2:
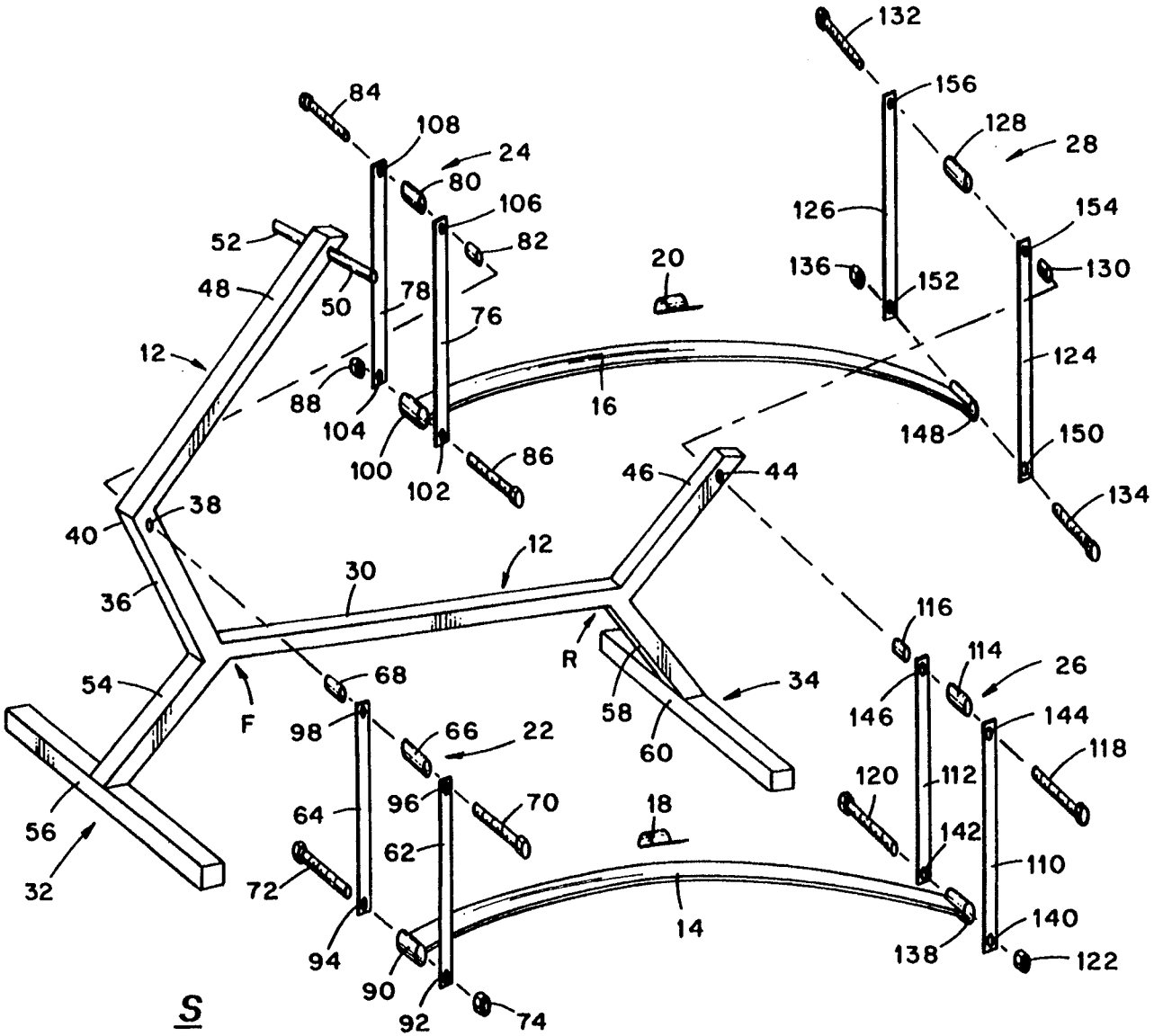
FIG. 2 is an exploded perspective view of the exercise machine of FIG. 1.

With further reference to FIG. 1 and with additional reference to FIG. 2, the frame 12 provides an elevated support for suspending the oscillators 14 and 16 in a generally horizontal orientation spaced above a support surface S on which the frame rests so that the surface does not interfere with movement of the oscillators. The frame 12 includes a spine member 30 which is disposed generally horizontally with respect to the ground and is supported a desired distance above the ground by a front T-shaped support 32 and a rear T-shaped support 34. The front support 32 is connected, such as by welding, to a front end F of the spine 30 and the rear support 34 is connected to a rear end R of the spine.

A front support post 36 extends upwardly and generally forwardly from the front end F of the spine 30 and may include a pair of threaded openings 38 and 40 on opposite sides thereof for mounting of the front oscillator supports 22 and 24 thereon. A rear support post 42 extends upwardly from the rear end R of spine member 30 and may also include a pair of threaded openings 44 and 46 on opposite sides thereof for mounting the rear oscillator supports 26 and 28 thereon.

A handle support 48 extends upwardly from the upper end of the front support post 36 in a generally rearward direction. A pair of hand grips 50 and 52 extend outwardly from opposite sides of the handle support 48 adjacent the upper end of the support 48 for being gripped by the hands of the user during exercise. It is noted that the length/angular dimensions of the support post 36 and handle support 48 are preferably such that the handle grips 50 and 52 are positioned in space for being gripped by the user with the arms of the user forwardly disposed from a generally upright standing position.

As stated previously, the T-shaped supports 32 and 34 support the member 30 a desired distance above the ground so that the movement of the oscillators is not encumbered by the underlying support surface. In addition, the T-shaped members provide stability to the frame so that the frame does not rock or otherwise move during exercise. To accomplish this, the front T-shaped support 32 is provided by a leg 54 which extends upwardly in a generally rearward direction from a cross member 56 and connects to the front end F of spine member 30 at an angle of about 135° with respect to the spine member.

The cross-member 56 is disposed along the support surface S, such as a floor, perpendicular to the spine 30 with its midpoint generally vertically aligned with the spine 30 and immediately below the upper end of the support post 36. Likewise, the rear T-shaped support 34 is provided by a leg 58 which extends upwardly and forwardly from a cross-member 60 and connects to the rear end R of the spine 30 at an angle of about 135° with respect to the spine so that legs 54 and 58 are at about a 90° angle with respect to each other and the plane containing the legs 54, 58 and spine member 30 is substantially vertical and bisects the right and left halves of the device.

The cross-member 60 is disposed along the support surface S perpendicular to the spine 30 with its midpoint generally vertically aligned with the spine 30 and immediately below the upper end of the support post 42.

Figure 3:
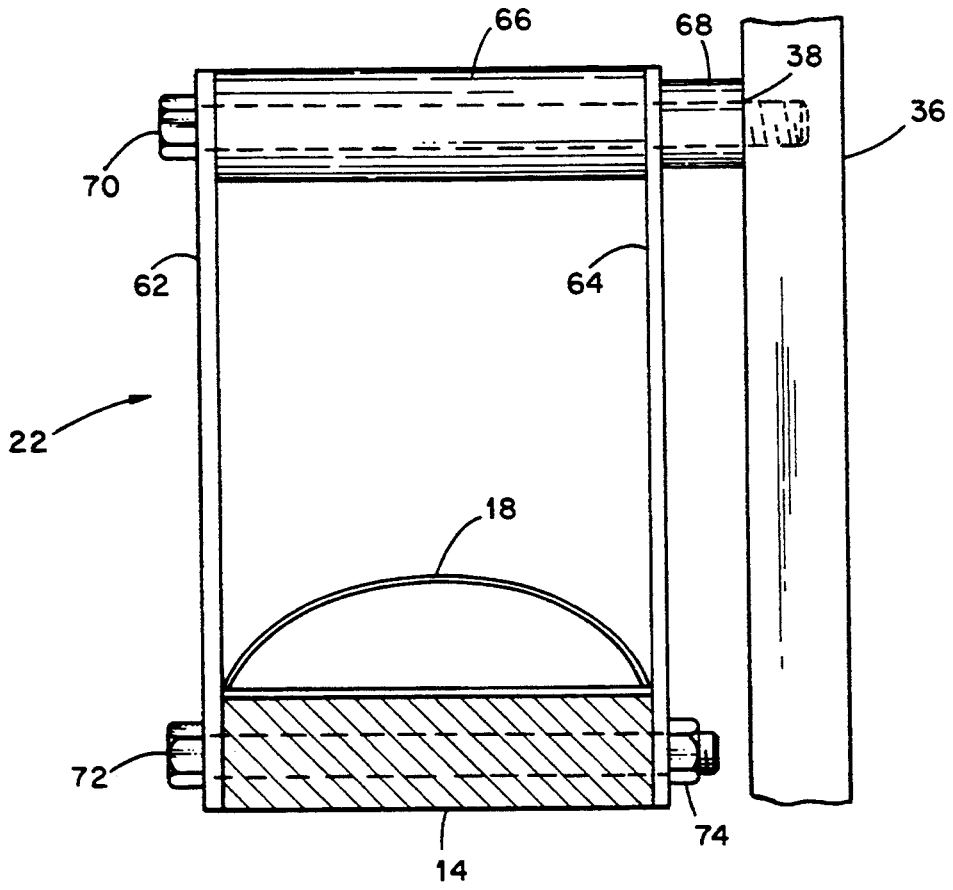
FIG. 3 is a fragmentary end view of the machine of FIG. 1 showing connection of an oscillator to the frame of the machine.

With continuing reference to FIGS. 1 and 2, and with additional reference to FIG. 3, the oscillators 14 and 16 are preferably provided by upwardly arched elongate strips formed of a resiliently deformable material such as spring steel so that the oscillators are internally biased against downward deflection and resiliently deflect downwardly in response to forces applied by the user through foot supports 18 and 20, and then spring back or elevate the supports 18 or 20 when the force is relaxed. Thus, in the depicted embodiment, each oscillator 14 and 16 may be provided by a leaf spring of the type commonly used in automobile suspensions and aligned in the assembled machine so that the bow or curvature of each leaf spring in the relaxed state is upwards or convex with respect to the ground. It will be understood, however, that the oscillators may be formed of composite materials such as fiberglass and may also be externally biased, as by springs, to resist deflection.

The foot supports 18 and 20 maintain the feet of the user in contact with the upper surface of the oscillators 14 and 16 and are generally fixedly positioned, such as by screws, to the oscillators at about the longitudinal midpoint. Suitable foot supports include elastic webbing or plastic shoe-shaped receptacles attached to the oscillators to fittingly receive the front end of the shoe or foot of the user. The foot supports are preferably adjustable, as by adjustment straps having mating hook and loop material, so as to be adjustable to fit different shoe sizes. In addition, when the movement to be simulated is skiing, the foot supports may be provided by ski bindings which receive a ski boot.

The oscillators are further aligned in the assembled machine 10 to be generally parallel to the spine 30 so that one end of each oscillator is adjacent the front end F and the other end of each oscillator is adjacent the rear end R. Accordingly, the front oscillator supports 22 and 24 support the front ends of the oscillators 14 and 16, respectively, and the rear oscillator supports 26 and 28 support the rear ends of the oscillators 14 and 16, respectively.

The front left-hand oscillator support 22, shown in detail in FIG. 3, includes a pair of elongate links 62 and 64, a spacer sleeve 66, a bushing 68, a pair of upper and lower bolts 70 and 72, respectively, and a nut 74. Likewise, as shown in FIG. 2, the front right-hand oscillator support 24 includes a pair of elongate links 76 and 78, a spacer sleeve 80, a bushing 82, a pair of upper and lower bolts 84 and 86, respectively, and a nut 88.

The front left-hand oscillator support 22 supports the front end of the oscillator 14. The links 62 and 64 of the support 22 are spaced apart and positioned on opposite sides of the front end of the oscillator 14 so that their lengths are generally perpendicular to the length of the oscillator when the oscillator is at rest.

The front end of the oscillator 14 includes an opening 90 which extends across the width of the oscillator and lower openings 92 and 94 in the links 62 and 64 are aligned relative to the opening 90. The shaft of the bolt 72 is received through the opening 90 and the openings 92 and 94 and is secured in place by the nut 74 so as to allow free pivotal movement of links 62 and 64 in relation to oscillator 14.

The upper ends of links 62, 64 are pivotally connected to support post 36 as by bolt 70, the threaded end of which is tightened into threaded opening 38 in the post adjacent the upper end of the post. The head end of the bolt is adjacent outer link 62, and its shaft is received through an upper opening 96 in link 62, the opening of spacer 66 separating the upper ends of links 62 and 64, an upper opening 98 in inner link 64, and an opening in bushing 68 located between inner link 64 and post 36 where upon the threaded end passes into threaded opening 38 in the post. The arrangement is such that upon tightening the bolt 70, the links 62, 64 are relatively freely rotatable on the bolt.

It will therefore be seen that the links 62, 64 support the front end of oscillator 14 in a depending fashion on frame 12 for forward and rearward oscillatory movement as the upper ends of links 62, 64 rotate on the shaft of bolt 70 and the lower ends of links 62, 64 rotate on the shaft of bolt 72.

The front right-hand oscillator support 24 supports the front end of the oscillator 16. The links 76 and 78 of the support 24 are spaced apart and positioned on opposite sides of the front end of the oscillator 16 so that their lengths are generally perpendicular to the length of the oscillator when the oscillator is at rest.

The front end of the oscillator 16 provides an opening 100 which extends across the width of the oscillator and lower openings 102 and 104 in the links 76 and 78 are aligned relative to the opening 100. The shaft of the bolt 86 is received through the opening 100 and the openings 102 and 104 and is secured in place by the nut 88 so as to allow free pivotal movement of links 76 and 78 in relation to oscillator 16.

The upper ends of links 76, 78 are pivotally connected to support post 36 as by the bolt 84, the threaded end of which is tightened into threaded opening 40 in the post 36 adjacent the upper end of the post. The head end of the bolt is adjacent outer link 78, and its shaft is received through an upper opening 108 in link 78, the opening of spacer 80 separating the upper ends of links 76 and 78, an upper opening 106 in inner line 76, and an opening in bushing 82 located between inner link 76 and post 36 where upon the threaded end passes into threaded opening 40 in the post. The arrangement is such that upon tightening the bolt 84, the links 76, 78 are relatively freely rotatable on the bolt.

It will therefore be seen that the links 76, 78 support the front end of oscillator 16 in a depending fashion on frame 12 for forward and rearward oscillatory movement as the upper ends of links 76, 78 rotate on the shaft of bolt 84 and the lower ends of links 76, 78 rotate on the shaft of bolt 86.

The rear left-hand oscillator support 26 includes a pair of elongate links 110 and 112, a spacer sleeve 114, a bushing 116, a pair of bolts 118 and 120, and a nut 122. Likewise, the right-hand rear oscillator support 28 includes a pair of elongate links 124 and 126, a spacer sleeve 128, a bushing 130, a pair of bolts 132 and 134, and a nut 136.

The rear left-hand oscillator support 26 supports the rear end of the oscillator 14. The links 110 and 112 of the support 26 are spaced apart and positioned on opposite sides of the rear end of the oscillator 14 so that their lengths are generally perpendicular to the length of the oscillator when the oscillator is at rest.

The rear end of the oscillator 14 provides an opening 138 which extends across the width of the oscillator and lower openings 140 and 142 in the links 110 and 112 are aligned relative to the opening 138. The shaft of the bolt 120 is received through the opening 138 and the openings 140 and 142 and is secured in place by the nut 122 so as to allow free pivotal movement of links 110 and 112 in relation to oscillator 16.

The upper ends of links 110,112 are pivotally connected to support post 42 as by the bolt 118, the threaded end of which is tightened into threaded opening 44 in the post 42 adjacent the upper end of the post. The head end of the bolt is adjacent outer link 110, and its shaft is received through an upper opening 144 in link 110, the opening of spacer 114 separating the upper ends of links 110 and 112, an upper opening 146 in inner link 112, and an opening in bushing 114 located between inner link 112 and post 42 where upon the threaded end passes into threaded opening 44 in the post. The arrangement is such that upon tightening the bolt 118, the links 110, 112 are relatively freely rotatable on the bolt.

It will therefore be seen that the links 110,112 support the front end of oscillator 14 in a depending fashion on frame 12 for forward and rearward oscillatory movement as the upper ends of links 110, 112 rotate on the shaft of bolt 118 and the lower ends of links 110, 112 rotate on the shaft of bolt 120.

The rear right-hand oscillator support 28 support the rear end of the oscillator 16. The links 124 and 126 of the support 28 are spaced apart and positioned on opposite sides of the front end of the oscillator 16 so that their lengths are generally perpendicular to the length of the oscillator when the oscillator is at rest.

The rear end of the oscillator 16 provides an opening 148 which extends across the width of the oscillator and lower openings 150 and 152 in the links 124 and 126 are aligned relative to the opening 148. The shaft of the bolt 134 is received through the opening 148 and the openings 150 and 152 and is secured in place by the nut 136 so as to allow free pivotal movement of links 124 and 126 in relation to oscillator 16.

The upper ends of links 124, 126 are pivotally connected to support post 42 as by the bolt 132, the threaded end of which is tightened into threaded opening 46 in the post adjacent the upper end of the post. The head end of the bolt is adjacent outer link 126, and its shaft is received through an upper opening 156 in link 126, the opening of spacer 128 separating the upper ends of links 124 and 126, an upper opening 154 in inner link 124, and an opening in bushing 128 located between inner link 124 and post 42 where upon the threaded end passes into threaded opening 46 in the post. The arrangement is such that upon tightening the bolt 134, the links 124, 126 are relatively freely rotatable on the bolt.

It will therefore be seen that the links 124, 126 support the rear end of oscillator 16 in a depending fashion on frame 12 for forward and rearward oscillatory movement as the upper ends of links 124, 126 rotate on the shaft of bolt 138 and the lower ends of links 124, 126 rotate on the shaft of bolt 134.

It will be appreciated that the oscillator supports may be otherwise supported by the frame. For example, the threaded openings 38 and 40 may be replaced by an opening which extends through the width of the support post 36 to fittingly receive a rod of sufficient length so that free ends of the rod are provided on either side of the support post to receive the links, spacer sleeves, and bushings of the front supports. Cotter pins may be passed through apertures in the free ends of the rod to maintain the supports thereon.

As stated previously, each oscillator is provided by a resiliently deformable material of the type which is internally biased to be flexible in a direction perpendicular to its length upon application of a force and which is capable of returning to its original shape after a removal of the force. In the depicted embodiment the oscillators are provided by automobile-type leaf springs, however, it is intended that many different materials and structures may be used to provide the oscillators performing equivalent functions.

To enable each oscillator to move in a path generally parallel to its length the front supports and rear supports are pivotally connected to the frame and to the oscillators. The oscillators are therefore capable of flexing and pivoting in a manner which replicates the perambulation simulated by the user, as will be explained more fully below. The oscillators are preferably selected to have sufficient stiffness so that they remain in the substantially unflexed position when supporting the still weight of the user, but resiliently deform in accordance with and conforming to foot movements of the user associated with perambulation. Thus, during exercise, the user stands on the oscillators 14 and 16 and the feet of the user are positioned in the foot supports 18 and 20 so that the user is standing on the oscillators straddling the frame member 30. The user performs the desired perambulatory movements and the oscillators flex and move in response to the movements. The oscillators flex in a path generally perpendicular to their length and move in a path generally parallel to their length so that the foot supports oscillate in generally parallel side-by-side paths which correspond to the path of the feet of the user during exercise.

It will therefore be seen that the foot supports oscillate in generally parallel side-by-side paths which correspond to the path of the feet of the user during exercise. This allows a variety of perambulatory movements, such as those associated with walking, jogging, running, skiing and jumping, to be simulated on the machine 10. For example, to simulate walking, the feet of the user would be moved in step paths as if walking on the ground, as shown in FIG. 4 which diagrammatically depicts various positions of a foot 160 of the user when simulating walking on the machine. Thus, during walking, the foot typically has a sequential range of motion as indicated by foot positions X, Y, and Z. Position X represents the starting position of the foot. In this position, the oscillator 14 may be slightly flexed in the direction of the arrow A since it is supporting the still weight of the user and the supports 22 and 26, as represented by the links 62 and 110, respectively, are in a substantially unpivoted orientation with respect to the frame. The foot then travels forward to foot position Y, which represents the position of the foot during the walking motion when the foot is substantially in front of the body of the user. As can be seen, the links 62 and 110 are pivoted clockwise as shown by the arrow B and the oscillator is substantially deformed or flattened. In addition, the swing or pivot of the oscillator supports elevates the front end and rear end of the oscillator a distance D above the starting position. The foot then travels to foot position Z, which represents the position of the foot during the walking motion when the foot is substantially behind the body of the user. As can be seen, the links 62 and 110 are pivoted counter-clockwise as shown by the arrow C and the oscillator is substantially unflexed with the front end and rear end elevated a distance E above the starting position. It will be appreciated that many variations of this movement cycle are possible. For example, the use may flex the oscillator in position X and allow it to relax in position Y and/or Z.

With reference now to FIGS. 5 through 8, there are shown various other embodiments of the invention. It will be appreciated that in each embodiment, the oscillators provide a forward and rearward component in the step path. FIG. 5 shows an embodiment illustrating a machine where the front end of each oscillator is suspended from a frame by a coil spring and the rear end of each oscillator is supported by a rod which is welded to the frame. Elements of this embodiment corresponding to elements of the embodiment 10 previously described will be referenced with the same characters using a prime suffix. Thus, in this embodiment, the exercise machine designated 10' consists of a frame 12' having a spine 30', a pair of oscillators 14' and 16' having foot supports 18' and 20', front oscillator supports 22' and 24', rear oscillator supports 26' and 28', and handles 50' and 52'. This embodiment is particularly well adapted for simulating jumping or marching-in-place movements.

The front left hand oscillator support 22' includes an elongate coil spring 162 supported by a loop or hanger 164 attached to the frame 12'. The hanger 164 is attached at its upper end, such as by welding, to a cross-member 165 of the frame which extends between the handles 50', 5240 at the front end F' of the frame above a cross-member 56' which rests lengthwise on the surface S' perpendicular to the spine 30'. The lower end of the hanger 164 attaches to the upper end of the coil spring. The lowermost coil of the coil spring 162 engagingly receives the left-end of a rod 166 which extends through an opening 90' in the front end of the oscillator 14'. The right-end of the rod 166 extends through an opening 100' in the front end of the oscillator 16' so 10 that the rod 166 extends between the front ends of the oscillators 14', 16'. The front right-hand oscillator support 24' likewise includes a coil spring 168 supported by a hanger 170, with the hanger supporting one end of the spring 168 and the lowermost coil of the coil spring 168 receiving the right-end of the rod 166 as stated above.

The rear left-hand oscillator support 26' includes a rod 172 welded to the left side of a support post 42' which extends upwardly from a cross-member 60' at the rear end R' of the frame 12'. The rod 172 extends through an opening 138' in the rear end of the oscillator 14'. A cotter pin (not shown) may be inserted into an opening provided through the free end of the rod 172 for maintaining the oscillator on the rod 172. In a similar manner, the rear right-hand oscillator support 28' is provided by a rod 174 welded to the right side of the support 42', the rod 174 extending through an opening 148' in the rear end of the oscillator 16'.

The front oscillator supports 22' and 24' allow limited horizontal movement of the front end of each oscillator and the coil springs dampen or soften the vertical motion of the oscillators. The horizontal movement is limited to the horizontal elongation of the oscillators resulting from their deformation in response to force exerted by the user. The rear osciallator supports retain the rear end of the oscillators in a fixed position so that elongation as a result of deformation, i.e. forward and rearward motion, is realized at the front end of the oscillators.

A further embodiment of the invention is illustrated in FIG. 6 where the front end of each oscillator is connected to a frame by a rod which is welded to the frame and the rear end of each oscillator is pivotally suspended from the frame in the same manner as are the oscillators of the embodiment 10. Elements of this embodiment corresponding to elements of the embodiment 10 previously described will be referenced with the same characters using a double prime suffix. In this embodiment, the exercise machine designated 10'' consists of a frame 12'' having a spine 30'', a pair of oscillators 14'' and 16'' having foot supports 18'' and 20'', front oscillator supports 22'' and 24'', rear oscillator supports 26'' and 28'', and handles 50'' and 52''.

The front left-hand oscillator support 22'' includes a rod 176 welded to the left side of a support post 36'' which extends upwardly from a cross-member 56'' at the front end F'' of the frame 12'' which rests lengthwise on the support surface S'' perpendicular to the spine 30''. The rod 176 extends through an opening 90'' in the front end of the oscillator 14''. A cotter pin (not shown) may be inserted into an opening provided through the free end of the rod 176 for maintaining the oscillator on the rod 176. In a similar manner, the front right-hand oscillator support 24'' is provided by a rod 178 welded to the right side of the support 36'', the rod 178 extending through an opening 100'' in the rear end of the oscillator 16''.

The front oscillator supports 22'', 24'' retain the front end of the oscillators 14'', 16'' in a fixed position so that elongation as a result of deformation is realized at the rear end of the oscillators. The rear oscillator supports 26'' and 28'' are suspended form a support post 42'' which extends upwardly from a cross-member 60'' at the rear end R'' of the frame 12''. The supports 26'' and 28'' are identical to the supports 26 and 28 described in accordance with embodiment 10, and pivot in response to deformation and relaxation of the oscillators 14'' and 16'' in the same manner as described for embodiment 10.

A still further embodiment of the invention is illustrated FIG. 7 where front and rear oscillator supports are suspended from the frame by ball joints. Elements of this embodiment corresponding to elements of the embodiment 10 previously described will be referenced with the same characters using a triple prime suffix. In this embodiment, the exercise machine designated 10''' consists of a frame 12''', a pair of oscillators 14''' and 16''' having foot supports 18''' and 20''', front oscillator supports 22''' and 24''', rear oscillator supports 26''' and 28''', and handles 50''' and 52''' after the manner of ski poles. This embodiment is particularly well adapted for simulating cross-country and downhill skiing since the oscillators may also move in a side-to-side rocking fashion in addition to side-by-side gliding and flexing so that three-dimensional step paths may be simulated with lateral, longitudinal and vertical variations.

In this embodiment, the frame 12''' includes a pair of spaced apart and side-by-side spines 30''' supported a distance above the support surface by generally "V"-shaped legs 180, one of which is provided at each end of each spine 30''. A cross-member 56''' spans between the front-ends of the spines and is supported above the spines by a pair of posts 36''' extending upwardly and inwardly from the legs 180 at the front end. Likewise, a cross-member 60''' spans between the rear-ends of the spines and is supported above the spines by a pair of posts 42''' extending upwardly and inwardly from the legs 180 at the rear end. The oscillators 14''' and 16''' are suspended between the spines 30''' rather than on opposite sides of a central spine.

The front left-hand oscillator support 22''' includes a pair of elongate links 62''' and 64''' and the lower end of the oscillator support 22''' may be identical to the lower end of the support 22 of embodiment 10. The upper end of the support 22''', includes a ball joint 182. The links 62''' and 64''' attach to opposite sides of a base 184 of the ball joint, such as by welding, to enable rotation of the support 22''' about its length axis and pivotal movement of the support in an orbital fashion relative to the frame to provide an expanded range of foot positions of the user's feet during simulation of perambulatory movement. The ball joint 182 includes a ball 186 welded to the base 184 and a cylindrical housing 188 formed on a sleeve 190. The ball is engagingly received within the housing 188. The sleeve 190 includes an opening 202 extending through the length thereof and sized to slide over a rod 204. The rod 204 extends parallel to the cross-member 56''' and is attached to the cross-member by blocks 205 which are welded to the cross-member and have openings therethrough for fittingly receiving the rod 204. The handle 50''' extends upwardly from the base 184 for grasping by the left hand of the user. Alternatively, the handle 50''' may be attached, as by releasable clips or by welding, to the block 205 above the base 184. The remaining supports 24''', 26'''' and 28''' are preferably identical to the support 22''', except the rear supports 26''' and 28''' are suspended from a rod 206 attached to the cross-member 60''' in the same manner as the rod 204 is attached to the cross-member 56'''.

Still another embodiment of the invention is illustrated in FIG. 8. Elements of this embodiment corresponding to elements of the embodiment 10 previously described will be referenced with the same characters using a quadruple prime suffix. This embodiment is identical in construction to the embodiment 10, except that the handle support 48 and the hand grips 50 and 52 have been removed and replaced with elongate poles 210 and 212 which are releasably connected at their lower ends, as by clips or holders 213 attached, as by welding to the spacer sleeves 66 and 80. Thus, in this embodiment 10'''' it will be appreciated that force may be transmitted to the oscillators by the user through leg movement and by exertion of force on the handles. For example, when simulating the perambulatory movement of walking, the user may also pull and push on the handles to exaggerate the pivotal motion of the oscillators on the oscillator supports. In this manner, the user may extend his stride length beyond that which would normally be experienced and also exercise upper body muscles. The poles 210 and 212 may be removed and the handle support 48 with hand grips 50 and 52 attached, as by bolts, to the support post to return the machine to the configuration of embodiment 10.

Although several embodiments of the aforementioned have been described in the foregoing detailed description, it will be understood that the invention is capable of numerous rearrangements, modifications and substitutions without departing from the scope and spirit of the appended claims.

I claim:

1. An exercise machine for simulating perambulatory movement which comprises a frame, a pair of oscillators, each of said oscillators including foot support means thereon for supporting a foot of a user, oscillator support means supporting said oscillators on said frame with said foot support means in spaced-apart side-by-side relationship to provide oscillatory movement of said foot support means along generally parallel side-by-side step paths, and bias means for biasing said oscillators against deflection to enable said oscillators to resiliently deflect in response to forces applied by the user through said foot support means and to provide resilient movement of said foot support means of said oscillators generally perpendicular to said step paths during movement of said foot support means along said foot paths.

2. The machine of claim 1, wherein said oscillators comprise elongate arched members containing said foot support means on the upper surfaces thereof so that forces applied to said arch members by the feet of the user on said foot support means urges said members toward a straightened out configuration, and said bias means is provided by means internally biasing said members into said arched configuration against forces applied thereto by the feet of the user on said foot support means so that said arched members resiliently deflect toward a straightened out configuration upon application of forces thereto by the feet of the user and return to said arched configuration upon withdrawal of said forces.

3. The machine of claim 2, wherein said elongate arched members comprise upwardly bowed elongate strips formed of a composite material and internally biased against downward deflection.

4. The machine of claim 1, wherein said foot support means comprise ski bindings attached to said oscillators.

5. The machine of claim 1, wherein said oscillator support means comprises means for movably connecting one end of each of said oscillators to said frame and means for rigidly connecting the other end of each of said oscillators to said frame.

6. The machine of claim 1, wherein said oscillator support means comprises links pivotally connecting said oscillators to said frame.

7. The machine of claim 3, wherein said oscillator support means comprises coil springs yieldably connecting one end of each of said oscillators to said frame and rods rigidly connecting the other end of each of said oscillators to said frame.

8. The machine of claim 3, wherein said oscillator support means comprise links pivotally connecting one end of each of said oscillators to said frame and rods rigidly connecting the other end of each of said oscillators to said frame.

9. The machine of claim 3, wherein said oscillator support means comprise ball joints pivotally and orbitally connecting said oscillators to said frame.

10. The machine of claim 9, further comprising a pole for grasping by a hand of the user, said pole being connected to one of said ball joints.

11. The machine of claim 3, further comprising at least one pole for grasping by the hand of the user, said pole being connected to one of said oscillators.

12. The machine of claim 1, wherein each of said step paths trace cyclical paths in generally parallel planes.

13. The machine of claim 3, wherein said cyclical paths are generally flattened circular paths.

14. The machine of claim 1, wherein said oscillators are independently movable, one with respect to the other, so that one of said oscillators may be advanced along its step path independently of the other at the discretion of the user.

15. The machine of claim 1, wherein said support means comprises links pivotally connecting said oscillators to said frame to accommodate movement of said oscillators and their associated foot support means along said step paths by pivotal movement of said links about pivot points on said frame.

16. The machine of claim 1, wherein said pivot points on said frame are fixed pivot points.

17. The machine of claim 1, wherein said oscillators comprise upwardly bowed elongate leaf springs with said foot support means located about midway along the length of the springs on the upper surface thereof and said support means comprises links, each link having a first end pivotally connected to said frame and a second end connected to one of said leaf springs adjacent an end thereof.

18. The machine of claim 1, wherein said oscillators comprise upwardly bowed elongate leaf springs with said foot support means located about midway along the length of the springs on the upper surface thereof and said support means comprises links, each link having a first end pivotally connected to a fixed pivot point on said frame and a second end pivotally connected to one of said leaf springs adjacent an end thereof so that said links swingably support said oscillators in depending relation on said frame for gliding lengthwise movement to accommodate oscillatory movement of said foot support means along said step paths.

19. The machine of claim 18, further comprising handle means on said frame positioned to be gripped by the user from a generally upright standing position with the feet of the user supported upon said foot support means.

20. The machine of claim 1, further comprising handle means on said frame positioned to be gripped by the user from a generally upright standing position with the feet of the user supported upon said foot support means.

21. An exercise machine for simulating perambulatory movement which comprises a frame, a pair of elongate upwardly arched members biased against downward deflection and containing foot support means on the upper surfaces thereof for supporting the feet of a user thereon so that forces applied to said arched members by the feet of the user on said foot support means urges said members toward a straightened out configuration, and arched member support means supporting said arched members in spaced-apart side-by-side relationship to provide forward and rearward oscillatory movement of said arched members.

22. The machine of claim 21, wherein said arched member support means comprise coil springs yieldably connecting one end of each of said arched members to said frame and rods rigidly connecting the other end of each of said arched members to said frame with said foot support means in spaced-apart side-by-side relationship to provide oscillatory movement of said foot support means along side-by-side step paths.

23. The machine of claim 21, wherein said arched member support means comprise links pivotally connecting one end of each of said arched members to said frame and rods rigidly connecting the other end of each of said arched members to said frame with said foot support means in spaced-apart side-by-side relationship to provide oscillatory movement of said foot support means along side-by-side step paths.

24. The machine of claim 21, wherein said arched member support means comprise ball joints pivotally and orbitally connecting each end of said arched members to said frame with said foot support means in spaced-apart side-by-side relationship to provide oscillatory movement of said foot support means along side-by-side step paths.

25. An exercise machine for simulating perambulatory movement which comprises a frame, a pair of elongate arched members containing foot support means on the upper surfaces thereof so that forces applied to said arch members by the feet of a user on said foot support means urges said members toward a straightened out configuration, support means supporting said arched members on said frame with said foot support means in spaced-apart side-by-side relationship to provide oscillatory movement of said foot support means along generally parallel side-by-side step paths, and means internally biasing said arched members into said arched configuration against forces applied thereto by the feet of the user on said foot support means so that said arched members resiliently deflect toward a straightened out configuration upon application of forces thereto by the feet of the user and return to said arched configuration upon withdrawal of said forces providing resilient movement of said foot support means of said arched members generally perpendicular to said step paths during movement of said foot support means along said foot paths.

26. The machine of claim 25, wherein said elongate arched members comprise upwardly bowed elongate strips formed of a composite material and internally biased against downward deflection.

27. The machine of claim 25, wherein said support means comprises coils springs yieldably connecting one end of each of said arched members to said frame and rods rigidly connecting the other end of each of said arched members to said frame.

28. The machine of claim 25, wherein said support means comprise links pivotally connecting one end of each of said arched members to said frame and rods rigidly connecting the other end of each of said arched members to said frame.

29. The machine of claim 25, wherein said support means comprise ball joints pivotally and orbitally connecting said arched members to said frame.

30. The machine of claim 29, further comprising a pole for grasping by a hand of the user, said pole being connected to one of said ball joints.

31. The machine of claim 29, further comprising at least one pole for grasping by the hand of the user, said pole being connected to one of said arched members.

32. An exercise machine for simulating perambulatory movement which comprises a frame, a pair of upwardly bowed elongate leaf springs including foot support means located about midway along the length of the springs on the upper surface thereof for supporting a foot of a user, leaf spring support links supporting said leaf springs on said frame with said foot support means in spaced-apart side-by-side relationship to provide oscillatory movement of said foot support means along generally parallel side-by-side step paths, each link having a first end pivotally connected to said frame and a second end connected to one of said leaf springs adjacent an end thereof, and bias means providing resilient movement of said foot support means of said springs generally perpendicular to said step paths during movement of said foot support means along said foot paths.

33. An exercise machine for simulating perambulatory movement which comprises a frame, a pair of upwardly bowed elongate leaf springs including foot support means located about midway along the length of the springs on the upper surface thereof, support links supporting said springs on said frame with said foot support means in spaced-apart side-by-side relationship to provide oscillatory movement of said foot support means along generally parallel side-by-side step paths, each link having a first end pivotally connected to a fixed pivot point on said frame and a second end pivotally connected to one of said leaf springs adjacent an end thereof so that said links swingably support said springs in depending relation on said frame for gliding lengthwise movement to accommodate oscillatory movement of said foot support means along said step paths, and bias means providing resilient movement of said foot support means of said leaf springs generally perpendicular to said step paths during movement of said foot support means along said foot paths.

34. The machine of claim 33, further comprising handle means on said frame positioned to be gripped by the user from a generally upright standing position with the feet of the user supported upon said foot support means.

* * * * *